US009193062B2

(12) United States Patent
Johnson et al.

(10) Patent No.: US 9,193,062 B2
(45) Date of Patent: Nov. 24, 2015

(54) POST LOCK TOOL HOLDER FOR L-SHAPED WRENCHES

(71) Applicant: WAGIC, INC., Los Gatos, CA (US)

(72) Inventors: Ronald L. Johnson, San Jose, CA (US); Yugen Patrick Lockhart, Palo Alto, CA (US)

(73) Assignee: WAGIC, INC., San Jose, CA (US)

( * ) Notice: Subject to any disclaimer, the term of this patent is extended or adjusted under 35 U.S.C. 154(b) by 23 days.

(21) Appl. No.: 13/835,387

(22) Filed: Mar. 15, 2013

(65) Prior Publication Data

US 2014/0262887 A1 Sep. 18, 2014

(51) Int. Cl.
*B25H 3/04* (2006.01)
*B65D 85/24* (2006.01)

(52) U.S. Cl.
CPC . *B25H 3/04* (2013.01); *B65D 85/24* (2013.01)

(58) Field of Classification Search
CPC ..... B25H 3/00; B25H 3/003; B25H 3/006; B65D 85/20; B65D 85/24
USPC ..... 206/349, 372, 373, 376–379, 443
See application file for complete search history.

(56) References Cited

U.S. PATENT DOCUMENTS

| | | | |
|---|---|---|---|
| 244,309 | A | 7/1881 | Rhodes |
| 363,331 | A | 5/1887 | Hammer |
| 364,422 | A | 6/1887 | LaForge |
| 580,235 | A | 4/1897 | Strum |
| 647,528 | A | 4/1900 | Schmidt |
| 763,745 | A | 6/1904 | Gheen |
| 873,363 | A | 12/1907 | Ross |
| 875,493 | A | 12/1907 | Beard |
| 959,408 | A | 5/1910 | Volbert |
| 1,000,900 | A | 8/1911 | Dorsey |
| 1,006,679 | A | 10/1911 | Rice |
| 1,100,070 | A | 6/1914 | Graham |
| 1,172,656 | A | 2/1916 | Yorgensen |

(Continued)

FOREIGN PATENT DOCUMENTS

| | | |
|---|---|---|
| CA | 1147176 | 5/1983 |
| CA | 1232781 A | 2/1988 |

(Continued)

OTHER PUBLICATIONS

Wagic Husky 29pc SEA& METRIC Ball-Head Key Set w/ Torque Handle, http://www.bing.com/shopping/wagic-husky-26pc-sea-metric-ball-head-hex-key-set-w-tor . . . , May 10, 2012.

*Primary Examiner* — Bryon Gehman
(74) *Attorney, Agent, or Firm* — Haverstock & Owens LLP

(57) ABSTRACT

A tool holder holds one or more tools when not being used. The tool holder comprises a body with a plurality of tool retainers for removably receiving a tool and a plurality of posts for securing the tool within the tool holder body when the tool holder is in a closed configuration. In some embodiments, the tool retainers are holding tubes, pockets or slots. In order to couple a tool with the tool holder, a lock door is moved to an open position and the tool is inserted into a tool retainer of the tool holder. Then the locked door is moved to a closed position where it is positioned over the tool and the tool is secured within the tool holder. The tool is securely held within the tool holder body and is not removable when the tool holder is in the closed position. In some embodiments, the tool holder is configured to hold a L-shaped hexagonal or round tool. In some embodiments, the tool holder is able to hold a plurality of tools of different sizes.

25 Claims, 7 Drawing Sheets

(56) References Cited

U.S. PATENT DOCUMENTS 1,187,542 A 6/1916 Kaas
D53,597 S 7/1919 Marcmann
1,337,769 A 4/1920 Hemming
1,398,583 A 11/1921 Bovee
1,425,270 A 8/1922 Morgan
1,500,852 A 7/1924 Shepard
1,502,044 A 7/1924 McCann
1,530,905 A 3/1925 Nance
1,559,097 A 10/1925 Hill
1,753,026 A 4/1930 Rosati
1,825,936 A 10/1931 Bodmer
1,888,222 A 11/1932 Curtis et al.
1,915,245 A 6/1933 Cook
1,944,606 A 1/1934 Little
1,970,409 A 8/1934 Wiedemann
2,236,333 A 3/1941 Cowles
2,332,656 A 10/1943 Mirando
2,346,364 A 4/1944 Dowe
D142,982 S 11/1945 Bloomfield
2,409,613 A 10/1946 Brooks
2,410,971 A 11/1946 Hartley
2,465,152 A 3/1949 Ellison
2,465,619 A 3/1949 Veit
2,475,268 A 7/1949 Wittle
2,485,991 A 10/1949 Stowell
D156,677 S 12/1949 Smith
D157,154 S 2/1950 Horton
2,509,507 A 5/1950 Kane
2,512,967 A 6/1950 Quiron
2,530,024 A 11/1950 Moody
2,532,336 A 12/1950 Minnich
2,569,069 A 9/1951 Motel
2,590,307 A 3/1952 Gibson
2,593,828 A 4/1952 Arey
2,604,211 A 5/1952 Steine
2,701,052 A 2/1955 Mantel
D175,056 S 6/1955 Wilson
2,715,028 A 8/1955 Dossie
2,719,042 A 9/1955 Epsy
2,726,091 A 12/1955 Topar
2,776,589 A 1/1957 Gregory
2,778,396 A 1/1957 Swain
D179,979 S 4/1957 Noga
2,800,816 A 7/1957 Tasciotti
2,804,970 A 9/1957 Kue et al.
2,810,472 A 10/1957 Midkiff
2,836,210 A 5/1958 Garofalo
2,844,244 A 5/1958 Hanson
2,842,020 A 7/1958 Traquinio
2,851,915 A 9/1958 Martinez
2,854,741 A 10/1958 Cholger
2,878,701 A 3/1959 Weersma
3,023,054 A 2/1962 Shigekuni
3,061,727 A 11/1962 Von Frankenberg Und Ludwingdorf
3,113,479 A 12/1963 Swingle
3,156,143 A 11/1964 Wolfe
3,222,959 A 12/1965 Clark
3,255,792 A 6/1966 Beck
3,257,991 A 6/1966 Mosch
D205,745 S 9/1966 Namfeldt
3,342,229 A 9/1967 Janes
3,343,434 A 9/1967 Schroeder
3,370,696 A 2/1968 Groe
3,424,039 A 1/1969 Scott
3,592,086 A 7/1971 Derwin
3,654,975 A 4/1972 Ballsmith et al.
3,667,518 A 6/1972 Stillwagon, Jr.
3,802,286 A 4/1974 Winklofer et al.
3,863,693 A 2/1975 Carniker
3,943,801 A 3/1976 Yates
3,958,469 A 5/1976 Meese
3,997,053 A 12/1976 Bondhus
4,000,767 A 1/1977 Geng
4,043,230 A 8/1977 Scrivens
4,124,915 A 11/1978 Schlicher
4,154,125 A 5/1979 Frank
4,196,761 A 4/1980 Royer
4,227,430 A 10/1980 Jameson et al.
4,235,269 A 11/1980 Kraus
4,238,862 A 12/1980 Leatherman
4,241,773 A 12/1980 Personnat
4,302,990 A 12/1981 Chrichton et al.
4,308,770 A 1/1982 MacDonald
4,310,094 A 1/1982 Hotchkiss
4,327,790 A 5/1982 Stevens et al.
4,384,499 A 5/1983 Shockley
D270,024 S 8/1983 Strasser
4,424,728 A 1/1984 MacDonald
4,448,097 A 5/1984 Rocca
4,469,109 A 9/1984 Mehl
4,476,751 A 10/1984 Mishima
4,525,889 A 7/1985 Dunau
4,542,667 A 9/1985 Jang
D284,810 S 7/1986 Kelemen, Sr.
4,598,822 A * 7/1986 Hemmings ..... 206/379
4,640,155 A 2/1987 Condon
4,699,020 A 10/1987 Bush et al.
4,699,030 A 10/1987 Yang
4,703,673 A 11/1987 Allen
4,711,353 A 12/1987 Rozmestor
4,716,795 A 1/1988 Corona et al.
4,716,796 A 1/1988 Corona et al.
4,767,006 A 8/1988 Wasem
4,783,867 A 11/1988 Tsao
4,787,276 A 11/1988 Condon
4,815,346 A 3/1989 Littlehorn
4,819,523 A 4/1989 Souza
4,819,800 A 4/1989 Wilson
4,820,090 A 4/1989 Chen
D302,102 S 7/1989 Amagaya
4,882,841 A 11/1989 Margolis
4,922,569 A 5/1990 Brinker et al.
4,926,721 A 5/1990 Hsiao
D308,462 S 6/1990 Komatsu
4,934,223 A 6/1990 Wong
D310,770 S 9/1990 Zamarripa
D311,124 S 10/1990 Learney
4,960,016 A 10/1990 Seals
4,974,477 A 12/1990 Anderson
4,979,407 A 12/1990 Hernandez et al.
5,029,707 A 7/1991 Feng
5,036,975 A 8/1991 Chow
5,042,658 A * 8/1991 Tiramani et al. ..... 206/349
5,062,173 A 11/1991 Collins et al.
5,063,796 A 11/1991 Gennep
5,065,487 A 11/1991 Yother
5,086,674 A 2/1992 Her
5,146,815 A 9/1992 Scott, III
5,147,038 A 9/1992 Pergeau
D333,769 S 3/1993 Jureckson
D334,516 S 4/1993 Tsunoda
D339,048 S 9/1993 Baum
5,251,352 A 10/1993 Cullison
5,263,389 A 11/1993 Frazell et al.
5,265,504 A 11/1993 Fruhm
D342,433 S 12/1993 Sorenson
5,271,300 A 12/1993 Zurbechen et al.
D343,106 S 1/1994 Eklind et al.
5,295,422 A 3/1994 Chow
5,320,004 A 6/1994 Hsiao
5,329,834 A 7/1994 Wong
5,394,984 A 3/1995 Aiba
D359,671 S 6/1995 Acosta
5,450,774 A 9/1995 Chang
5,450,775 A 9/1995 Kozak
5,461,950 A 10/1995 Iwinski
D365,681 S 1/1996 Chow
5,480,166 A 1/1996 Milsop
5,495,942 A 3/1996 Ishak
5,499,560 A 3/1996 Aeschliman
5,499,562 A 3/1996 Feng
5,505,316 A 4/1996 Lee
5,517,885 A 5/1996 Feng

(56) References Cited

U.S. PATENT DOCUMENTS 5,522,291 A 6/1996 Liu
5,535,882 A 7/1996 Liu
5,542,322 A 8/1996 Knox et al.
D373,943 S 9/1996 Fuhrmann
5,553,340 A 9/1996 Brown, Jr.
5,566,596 A 10/1996 Lin
D376,520 S 12/1996 Morin
5,581,834 A 12/1996 Collins
D377,444 S 1/1997 Lin
5,592,859 A 1/1997 Johnson et al.
D378,797 S 4/1997 Poremba et al.
D380,131 S 6/1997 Sung
D382,190 S 8/1997 Blackston et al.
5,653,525 A 8/1997 Park
D383,048 S 9/1997 Sorenson et al.
5,662,013 A 9/1997 Lin
D385,172 S 10/1997 Bramsiepe et al.
D386,955 S 12/1997 Jones et al.
5,692,656 A 12/1997 Dembicks
D388,609 S 1/1998 Chan
5,711,042 A 1/1998 Chuang
5,711,194 A 1/1998 Anderson et al.
D394,792 S 6/1998 Bourque
D394,794 S 6/1998 Vasudeva
5,758,870 A 6/1998 Weaver
5,765,247 A 6/1998 Seber et al.
5,765,454 A 6/1998 Barbulescu et al.
5,768,960 A 6/1998 Archuleta
5,791,211 A 8/1998 Bondhus et al.
5,803,584 A 9/1998 Chung
5,816,401 A * 10/1998 Vasudeva et al. ..... 206/377
5,820,288 A 10/1998 Cole
5,822,830 A 10/1998 Lin
D400,775 S 11/1998 Hsu
5,855,274 A 1/1999 Paio
D405,335 S 2/1999 Lin
5,911,799 A 6/1999 Johnson et al.
5,916,277 A 6/1999 Dallas
5,916,341 A 6/1999 Lin
5,918,513 A 7/1999 Ho
5,918,741 A 7/1999 Vasudeva
5,938,028 A 8/1999 Hu
5,970,828 A 10/1999 Bondhus et al.
D415,946 S 11/1999 Tsai
5,983,759 A 11/1999 Turner
5,992,626 A 11/1999 Anderson
D420,885 S 2/2000 Lin
6,032,332 A 3/2000 Lin
6,032,796 A * 3/2000 Hopper et al. ..... 206/377
6,044,973 A 4/2000 Vasudeva
D426,449 S 6/2000 Eklind
D426,450 S 6/2000 Eklind
D427,875 S 7/2000 Chiu
6,085,620 A 7/2000 Anderson et al.
6,088,861 A 7/2000 Sessions et al.
6,089,133 A 7/2000 Liao
6,092,656 A 7/2000 Ernst
6,095,018 A 8/2000 Schuster
6,105,767 A 8/2000 Vasudeva
6,119,560 A 9/2000 Anderson et al.
6,128,981 A 10/2000 Boundhus et al.
6,131,740 A * 10/2000 Huang ..... 206/372
D433,613 S 11/2000 Jialin
D433,910 S 11/2000 Oliver et al.
6,151,998 A 11/2000 Fu-Hui
D435,415 S 12/2000 Johnson
6,164,172 A 12/2000 Huang
D435,773 S 1/2001 Lin
D437,541 S 2/2001 Hermansen et al.
D437,763 S 2/2001 Oliver et al.
6,186,785 B1 2/2001 Rogers et al.
6,202,864 B1 3/2001 Ernst et al.
6,206,189 B1 3/2001 Huot, Jr. et al.
D440,852 S 4/2001 Ernst
6,233,769 B1 5/2001 Seber et al.
6,237,451 B1 5/2001 Wei
6,257,106 B1 7/2001 Anderson et al.
6,260,453 B1 7/2001 Anderson et al.
6,279,434 B1 8/2001 Brown
6,279,435 B1 8/2001 Zayat, Jr.
D448,267 S 9/2001 Jean et al.
6,308,599 B1 10/2001 Fu-Hui
6,311,587 B1 11/2001 Johnson et al.
6,314,838 B2 11/2001 Wall
6,318,218 B1 11/2001 Anderson et al.
6,332,381 B1 12/2001 Vasudeva
6,345,557 B1 2/2002 Kuo
D454,766 S 3/2002 Lin
6,357,068 B1 3/2002 Seber et al.
D455,630 S 4/2002 Chiu
6,371,290 B1 4/2002 Yearous et al.
6,378,402 B1 4/2002 Kalomeris et al.
6,382,057 B1 5/2002 Kienholz
6,389,931 B1 5/2002 Delaney et al.
6,397,709 B1 6/2002 Wakk
6,401,576 B1 6/2002 Wu
6,401,923 B1 * 6/2002 Huang ..... 206/376
6,405,620 B2 6/2002 Liao
D459,967 S 7/2002 Johnson et al.
D461,311 S 8/2002 Gharib
D462,002 S 8/2002 Jean et al.
6,427,564 B1 8/2002 Nelson
6,490,954 B2 12/2002 Johnson et al.
6,510,766 B1 1/2003 Lin
6,510,767 B1 1/2003 Rivera
D470,739 S 2/2003 Chen
D472,712 S 4/2003 Sagen
D472,931 S 4/2003 Leins
6,564,680 B1 5/2003 Rinner et al.
6,598,503 B1 7/2003 Cunningham
6,601,481 B2 8/2003 Chuang
6,606,925 B1 8/2003 Gmeilbauer
D479,963 S 9/2003 Chang
6,634,502 B1 10/2003 Yu
6,640,675 B1 11/2003 Chuang
6,675,678 B2 1/2004 Liu
6,698,318 B2 3/2004 Peters
6,701,813 B2 3/2004 Hu
6,709,196 B1 * 3/2004 Medendorp ..... 206/349
6,739,224 B1 5/2004 Wershe
6,751,819 B2 6/2004 Chuang
6,751,820 B1 6/2004 Wu
6,752,046 B1 6/2004 Lee
6,758,350 B2 7/2004 Lin
6,763,744 B2 7/2004 Johnson et al.
D494,438 S 8/2004 Falkenstein et al.
6,799,490 B1 10/2004 Chu
6,827,210 B2 * 12/2004 Chen ..... 206/349
6,863,471 B2 * 3/2005 Medendorp ..... 206/349
6,877,186 B2 4/2005 Shiao
6,898,998 B2 5/2005 Shyu
6,901,826 B2 6/2005 Huang
6,918,323 B2 7/2005 Arnold et al.
6,922,870 B2 8/2005 Tontz, Sr.
6,925,910 B2 8/2005 Alford
6,928,908 B1 8/2005 Yu
6,935,211 B2 8/2005 Chen
6,941,843 B2 9/2005 Johnson et al.
6,948,406 B1 9/2005 Li
6,968,758 B2 11/2005 Lin
6,988,616 B2 * 1/2006 Chen ..... 206/379
D517,391 S 3/2006 Leins
7,028,593 B1 4/2006 Lin et al.
7,047,847 B2 5/2006 Chuang
7,051,626 B1 5/2006 Chen
7,051,629 B2 5/2006 Huang
D523,637 S 6/2006 Chang
7,073,418 B2 7/2006 Kuo
7,080,582 B2 7/2006 Karle
7,086,314 B2 8/2006 Wannop
7,093,519 B1 8/2006 Huang
D527,903 S 9/2006 Chang
7,100,476 B1 9/2006 Feit
7,131,358 B2 11/2006 Hsien

(56) References Cited

U.S. PATENT DOCUMENTS

| | | | | |
|---|---|---|---|---|
| 7,140,280 | B2 | 11/2006 | Hawkins | |
| 7,143,669 | B2 | 12/2006 | Hu | |
| 7,150,208 | B2 | 12/2006 | Debley | |
| 7,155,998 | B1 | 1/2007 | Shyu | |
| 7,159,260 | B2 | 1/2007 | Hansen | |
| 7,159,491 | B1 | 1/2007 | Chaconas et al. | |
| 7,165,479 | B1 | 1/2007 | Lee | |
| 7,168,345 | B1 | 1/2007 | Hsieh | |
| 7,182,003 | B1 | 2/2007 | Hsieh | |
| 7,185,565 | B1 | 3/2007 | Hu | |
| 7,216,569 | B2 | 5/2007 | Adbdlgany | |
| 7,237,463 | B1 | 7/2007 | Lee | |
| D548,464 | S | 8/2007 | Lin | |
| D549,069 | S | 8/2007 | Lin et al. | |
| 7,281,454 | B2 | 10/2007 | Johnson et al. | |
| 7,284,466 | B1 | 10/2007 | Ho | |
| D557,099 | S | 12/2007 | Lin | |
| 7,305,908 | B2 | 12/2007 | Chi | |
| 7,409,894 | B1 | 8/2008 | Valentine | |
| 7,467,574 | B1 | 12/2008 | Lin | |
| 7,467,575 | B2 | 12/2008 | Lai | |
| 7,565,852 | B2 | 7/2009 | Yu | |
| 7,571,517 | B2 | 8/2009 | Smith et al. | |
| 7,600,640 | B2 | 10/2009 | Hallee et al. | |
| D604,509 | S | 11/2009 | Andrews | |
| 7,698,972 | B2 | 4/2010 | Hi | |
| 7,743,685 | B2 | 6/2010 | Chang | |
| D622,125 | S | 8/2010 | Robinson | |
| D623,037 | S | 9/2010 | Johnson et al. | |
| 7,788,996 | B2 | 9/2010 | Johnson et al. | |
| 7,810,415 | B2 | 10/2010 | Adamany et al. | |
| 7,815,058 | B2 | 10/2010 | Cheng | |
| 7,836,534 | B2 | 11/2010 | Simmons | |
| 7,846,203 | B2 | 12/2010 | Cribier | |
| 7,946,203 | B2 | 5/2011 | Johnson et al. | |
| 8,011,277 | B2 | 9/2011 | Johnson et al. | |
| 8,015,642 | B1 | 9/2011 | Oakley | |
| 8,033,200 | B2 | 10/2011 | Johnson et al. | |
| D650,257 | S | 12/2011 | Royes et al. | |
| 8,336,428 | B2 | 12/2012 | Johnson et al. | |
| 8,468,916 | B2 | 6/2013 | Johnson et al. | |
| 8,613,121 | B1 | 12/2013 | White | |
| 8,640,574 | B2 | 2/2014 | Johnson et al. | |
| 2001/0005576 | A1 | 6/2001 | Roger et al. | |
| 2001/0045145 | A1 | 11/2001 | Legg | |
| 2003/0047474 | A1 | 3/2003 | Dahlson | |
| 2003/0126957 | A1 | 7/2003 | Huang | |
| 2003/0136234 | A1 | 7/2003 | Cunningham | |
| 2003/0188610 | A1 | 10/2003 | Lin | |
| 2003/0226428 | A1 | 12/2003 | Liu | |
| 2004/0050218 | A1 | 3/2004 | Napoli | |
| 2004/0173061 | A1 | 9/2004 | Liou | |
| 2004/0262344 | A1 | 12/2004 | White | |
| 2005/0011318 | A1 | 1/2005 | Tsai | |
| 2005/0199108 | A1 | 9/2005 | Jheng | |
| 2005/0229752 | A1 | 10/2005 | Nickipuck | |
| 2005/0247587 | A1 | 11/2005 | Holland-Letz | |
| 2005/0268752 | A1 | 12/2005 | Johnson et al. | |
| 2005/0268754 | A1 | 12/2005 | Fa | |
| 2005/0284267 | A1 | 12/2005 | Liao | |
| 2006/0042428 | A1 | 3/2006 | Chuang | |
| 2006/0101955 | A1 | 5/2006 | Chang | |
| 2006/0118500 | A1 | 6/2006 | Chen | |
| 2006/0150784 | A1 | 7/2006 | Hsieh | |
| 2006/0213059 | A1 | 9/2006 | Eggert | |
| 2006/0254396 | A1 | 11/2006 | Hu | |
| 2006/0288531 | A1 | 12/2006 | Hu | |
| 2006/0288823 | A1 | 12/2006 | Schepman | |
| 2007/0023306 | A1 | 2/2007 | Lai | |
| 2007/0044598 | A1 | 3/2007 | Frohm et al. | |
| 2007/0056117 | A1 | 3/2007 | Gardiner et al. | |
| 2007/0056872 | A1 | 3/2007 | Begim | |
| 2007/0062831 | A1* | 3/2007 | Chen | 206/373 |
| 2007/0084740 | A1* | 4/2007 | Malek | 206/373 |
| 2007/0151402 | A1 | 7/2007 | Schneerman et al. | |
| 2007/0221017 | A1 | 9/2007 | Heaven | |
| 2007/0228672 | A1 | 10/2007 | Huang | |
| 2007/0245862 | A1 | 10/2007 | Gonzalez et al. | |
| 2007/0295171 | A1 | 12/2007 | Johnson et al. | |
| 2008/0128370 | A1 | 6/2008 | Shih | |
| 2008/0148909 | A1 | 6/2008 | Lai | |
| 2008/0156754 | A1 | 7/2008 | Cheng | |
| 2008/0164171 | A1 | 7/2008 | Meng | |
| 2008/0190249 | A1 | 8/2008 | Yu | |
| 2008/0202963 | A1 | 8/2008 | Liao | |
| 2008/0223179 | A1 | 9/2008 | Nash et al. | |
| 2008/0251402 | A1 | 10/2008 | Chiu | |
| 2008/0256816 | A1 | 10/2008 | Consentino | |
| 2008/0271573 | A1 | 11/2008 | Lown et al. | |
| 2008/0295657 | A1 | 12/2008 | Chuthe | |
| 2009/0107303 | A1 | 4/2009 | Steinweg et al. | |
| 2009/0183608 | A1 | 7/2009 | Johnson et al. | |
| 2009/0183609 | A1 | 7/2009 | Johnson et al. | |
| 2009/0241740 | A1 | 10/2009 | Heagerty | |
| 2010/0258465 | A1* | 10/2010 | Gomas | 206/378 |
| 2011/0000024 | A1 | 1/2011 | Johnson et al. | |
| 2011/0094910 | A1* | 4/2011 | Fleury et al. | 206/372 |
| 2012/0012485 | A1 | 1/2012 | Wang | |
| 2013/0228484 | A1* | 9/2013 | Yang | 206/349 |

FOREIGN PATENT DOCUMENTS

| | | | |
|---|---|---|---|
| CN | 2628230 | | 7/2004 |
| CN | 2628230 | Y | 7/2004 |
| DE | 464002 | | 8/1928 |
| DE | 2035793 | B1 | 3/1972 |
| DE | 2453480 | A1 | 5/1976 |
| DE | 3744176 | A1 | 8/1988 |
| DE | 102004011892 | | 1/2005 |
| DE | 202004013404 | U1 | 3/2005 |
| DE | 20 2007 003841 | U1 | 9/2007 |
| EP | 856223 | | 12/1960 |
| EP | 503559 | A1 | 9/1992 |
| EP | 618046 | A1 | 10/1994 |
| EP | 01693163 | | 2/2006 |
| EP | 01777042 | | 4/2007 |
| FR | 787512 | | 9/1935 |
| JP | 55045442 | U | 3/1980 |
| JP | 57-13165 | | 1/1982 |
| JP | 61136778 | | 6/1986 |
| JP | 3-47775 | | 5/1991 |
| JP | 03103162 | | 10/1991 |
| JP | 4-29368 | | 3/1992 |
| JP | 5-31882 | | 4/1993 |
| JP | 08505812 | | 6/1996 |
| TW | I236402 | | 7/2005 |
| TW | M284496 | | 1/2006 |
| TW | M284500 | | 1/2006 |
| TW | M296765 | | 9/2006 |
| TW | I270445 | | 1/2007 |
| WO | 83/01406 | | 4/1983 |
| WO | 9412322 | A1 | 6/1994 |
| WO | 9623631 | | 8/1996 |
| WO | 97/29887 | | 8/1997 |

* cited by examiner

POST LOCK TOOL HOLDER FOR L-SHAPED WRENCHES

FIELD OF THE INVENTION

The present invention relates to the field of hand held tools. More specifically, the present invention relates to the field of hexagonal wrenches and related tools and safety, comfort, and convenience of accessories and tools.

BACKGROUND OF THE INVENTION

Hexagonal wrenches or tool drivers, also referred to as allen wrenches or L-wrenches, have a hexagonal L-shaped body, including a long leg member and a short leg member. The end of either leg member is able to be inserted into a head of a screw or tool designed to accept a hexagonal wrench. Hexagonal wrenches are manufactured and distributed in multiple English and metric sizes in order to facilitate their use with screw heads of multiple sizes. Such wrenches are usually sold in a set which includes wrenches of multiple sizes but are also distributed individually.

When using a hexagonal wrench, a user, will insert an end of the hexagonal wrench into the head of a workpiece such as a screw, and will then exert rotational pressure on the opposite end of the wrench in order to tighten or loosen the screw. Multiple sizes of hexagonal wrenches are often used together in order to complete a task. Consequently, it is convenient to store multiple tools of different sizes in a common location.

SUMMARY OF THE INVENTION

A tool holder holds one or more tools when not being used. The tool holder comprises a body with a plurality of tool retainers for removably receiving a tool and a plurality of posts for securing the tool within the tool holder body when the tool holder is in a closed configuration. In some embodiments, the tool retainers are holding tubes, pockets or slots. In order to couple a tool with the tool holder, a lock door is moved to an open position and the tool is inserted into a tool retainer of the tool holder. Then the locked door is moved to a closed position where it is positioned over the tool and the tool is secured within the tool holder. The tool is securely held within the tool holder body and is not removable when the tool holder is in the closed position. In some embodiments, the tool holder is configured to hold a L-shaped hexagonal or round tool. In some embodiments, the tool holder is able to hold a plurality of tools of different sizes.

In one aspect, a tool holder comprises a tool holder body comprising one or more tool retainers, a lock door movable between an open position and a closed position, and a back panel. In some embodiments, the tool holder is configured for holding a L-shaped round or hexagonal tool. In order to couple a L-shaped tool with the tool holder a long leg of the tool is inserted into one of the one or more of the tool retainers. In some embodiments, when the tool is coupled with the tool holder, the short leg of the tool extends at a 90° orientation with respect to the retainer and the long leg of the tool extends from a bottom of the tool retainer. In some embodiments, the tool is prevented from being removed from the tool retainer when the lock door is in the closed position independent of a vacancy of one or more neighboring tool retainers. In some embodiments, the lock door moves to the open position by rotating away from the back panel and about a hinge. In some of these embodiments, the hinge comprises a pivot pin, slide, access or clip. In further embodiments, the lock door is removed from, slid, and/or retracted from the back panel in order to move to the open position. In some embodiments, the one or more tool retainers are configured to each hold one or more tools of different sizes. In some embodiments, the one or more tool retainers are arranged in a single row, multiple rows, over laid side-by-side, or front to back. In some embodiments, the one or more tool retainers comprise holding tubes, pockets or slots. In further embodiments, the tool holder comprises one or more posts that secure a L-shaped tool in place in order to prevent the tool from being removed when the lock door is in the closed position. In still further embodiments, the tool holder comprises one or more securing protrusions that secure the L-shaped tool in place in order to prevent them from being removed when the lock door is in the closed position. In some embodiments, the one or more securing protrusions interlock with the back panel in order to snap fit to the back panel and secure the lock door into place. In further embodiments, the tool holder further comprises a lock that secure the lock door into place.

In another aspect, a tool for holding a plurality of tools comprises a tool holder body comprising a plurality of tool retainers, each for removably holding a tool and a lock door movable between an open position and a closed position, wherein when a tool is coupled with a retainer, the tool is prevented from being removed from the tool retainer when the lock door is in the closed position independent of a vacancy of one or more neighboring tool retainers. In some embodiments, the tool holder is configured for holding a L-shaped round or hexagonal tool. In order to couple a L-shaped tool with the tool holder a long leg of the tool is inserted into one of the plurality of tool retainers. In some embodiments, when a tool is coupled with the tool holder, the short leg of the tool extends at a 90° orientation with respect to the holding tube and the long leg of the tool extends from a bottom of the tool retainer. In some embodiments, the lock door moves to the open position by rotating away from the back panel and about a hinge. In some of these embodiments, the hinge comprises a pivot pin, slide, access or clip. In further embodiments, the lock door is removed from, slid, and/or retracted from the back panel in order to move to the open position. In some embodiments, the plurality of tool retainers are configured to each hold a tool of different sizes. In some embodiments, the plurality of tool retainers are arranged in a single row, multiple rows, over laid side-by-side, or front to back. In some embodiments, the plurality of tool retainers comprise holding tubes, pockets or slots. In some embodiments, the tool holder further comprises one or more posts that secure a L-shaped tool in place in order to prevent the tool from being removed when the lock door is in the closed position. In further embodiments, the tool holder further comprises one or more securing protrusions that secure the L-shaped tool in place in order to prevent them from being removed when the lock door is in the closed position. In some of these embodiments, the one or more securing protrusions interlock with the back panel in order to snap fit to the back panel and secure the lock door into place. In some embodiments, the tool holder further comprises a lock that secure the lock door into place. In further embodiments, the tool holder comprises a first set of holding tubes and a second set of retainers.

In still further embodiments, a method of removably securing a L-shaped tool with a tool holder comprises moving a lock door to an open position, inserting one or more L-shaped tools into one or more tool retainers of the tool holder and moving the lock door to a close position in order to secure one or more tools within the one or more tool retainers. In some embodiments, the lock door moves to the open position by rotating away from the back panel about a hinge. In some embodiments, the one or more tool retainers are configured to each hold a tool of different sizes. In some embodiments, a tool is prevented from being removed from the tool retainer when the lock door is in the closed position independent of a vacancy of one or more neighboring tool retainers. In some embodiments, the one or more tool retainers comprise holding tubes, pockets or slots.

DETAILED DESCRIPTION OF THE PREFERRED EMBODIMENT

The description below concerns several embodiments of the invention. The discussion references the illustrated preferred embodiment. However, the scope of the present invention is not limited to either the illustrated embodiment, nor is it limited to those discussed, to the contrary, the scope should be interpreted as broadly as possible based on the language of the Claims section of this document.

This disclosure provides several embodiments of the present invention. It is contemplated that any features from any embodiment can be combined with any features from any other embodiment. In this fashion, hybrid configurations of the illustrated embodiments are well within the scope of the present invention.

Figure 1:
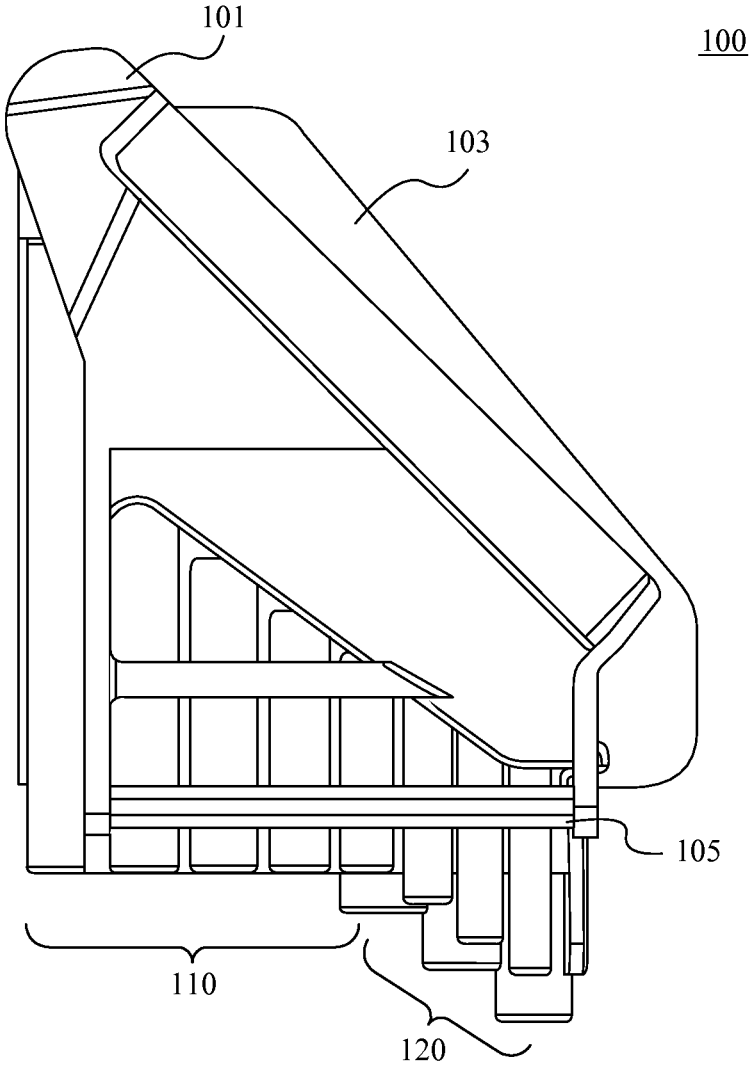
FIG. 1 illustrates a tool holder for holding a tool in accordance with some embodiments.

Referring now to FIG. 1, a first embodiment of a tool holder is depicted therein. The tool holder 100 comprises a tool holder body having a lock door 101, a back panel 103 and a hinge 105. As shown in FIG. 1, the tool holder 100 further comprises a first set of tool retainers 110 and a second set of tool retainers 120. In some embodiments, the tool retainers are holding tubes, pockets or slots. As will be apparent to someone of ordinary skill in the art, the tool holder 100 is able to comprise any number of sets of tool retainers and any number of tool retainers, including one. In some embodiments, the sets of tool retainers are arranged in an overlapping configuration. However, the tool retainers are able to be arranged in any desired configuration. For example, in some embodiments, the tool retainers are arranged in a single row, multiple rows, over laid out side-by-side, or front to back.

The tool holder 100 is configured for holding one or more L-shaped tools within the tool retainers. The L-shaped tool is able to have any shape including hexagonal, round, or any other appropriate shape. In some embodiments, each tool retainer is of a size and a dimension which corresponds to one or more tool sizes. In some embodiments, the tool storage tubes are configured for holding a plurality of tools of different sizes.

Figure 2:
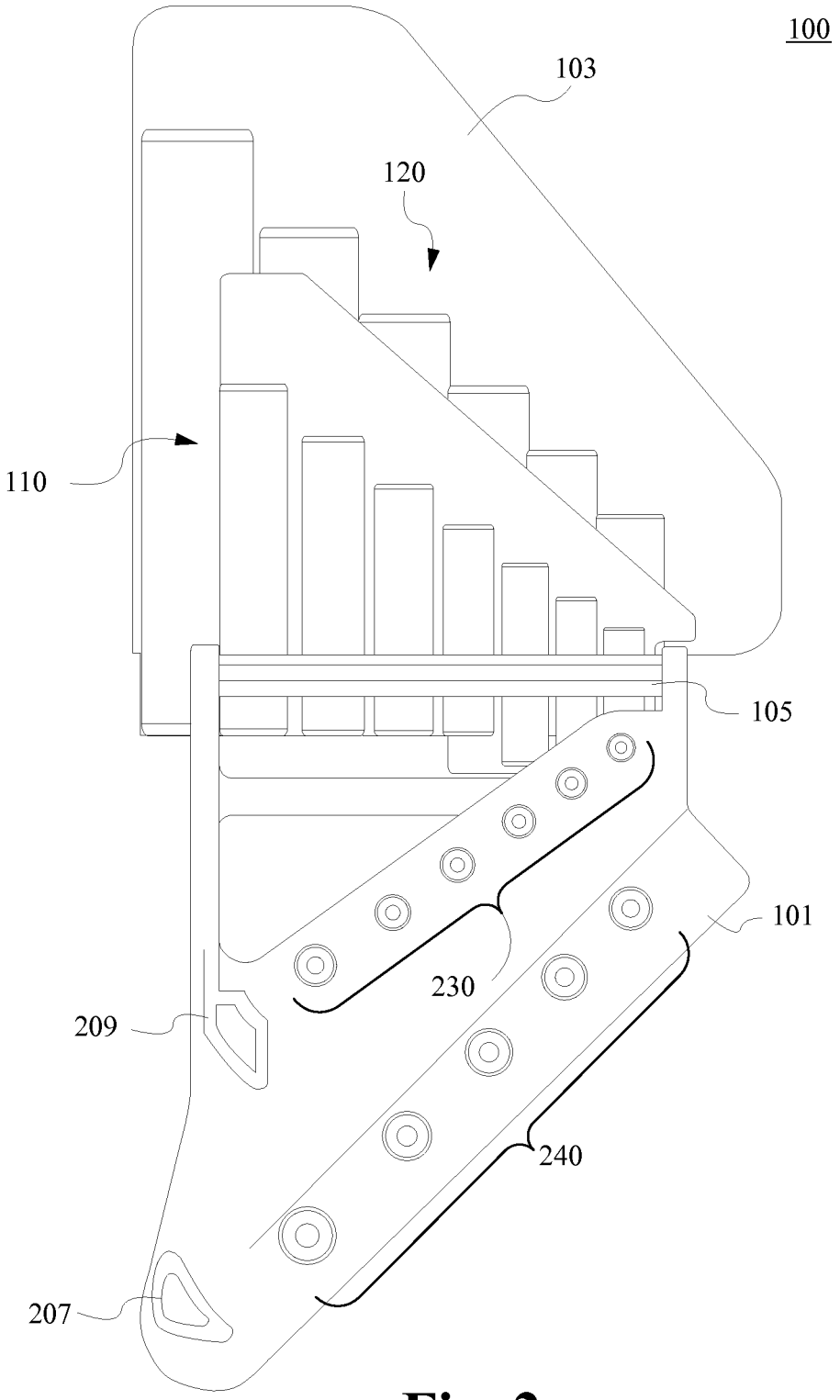
FIG. 2 illustrates a tool holder in an open configuration in accordance with some embodiments.

FIG. 2 illustrates a tool holder in an open configuration in accordance with some embodiments. The tool holder 100 shown in FIG. 2 is similar to the tool holder 100 as described in relation to FIG. 1 and comprises a tool holder body having a lock door 101, a back panel 103, and a hinge 105. The tool holder body also comprises a first set of a first set of tool retainers 110 and a second set of tool retainers 120. In some embodiments, the tool retainers are holding tubes, pockets or slots. As shown within FIG. 2, the lock door 101 has been opened by rotating the lock door 101 away from the back panel 103 about the hinge 105 and placed in the open position. In some embodiments, the hinge 105 comprises a pivot pin in order to rotate the lock door to the open position. In some embodiments, the lock door 101 is removed, slid, and/or retracted in order to access the first set of tool retainers 110 and the second set of tool retainers 120.

As further shown in FIG. 2, the inside of the lock door 101 comprises a first set of posts 230 and a second set of posts 240 and one or more securing protrusions 207 and 209. In some embodiments, the number of posts is the same as the number of tool retainers. The first set of posts 230, the second set of posts 240 and the one or more securing protrusions 207 and 209 help secure a L-shape tool in place when it is coupled with the tool handle 100 and the lock door 101 is placed in a closed position. In some embodiments, the one or more securing protrusions 207 and 209 interlock with the back panel 103 in order to snap fit to the back panel and secure the lock door 101 into place. Although two securing protrusions are shown in FIG. 2, as will be apparent to someone of ordinary skill in the art, the tool holder 100 is able to comprise any number of securing protrusions.

Figure 3A:
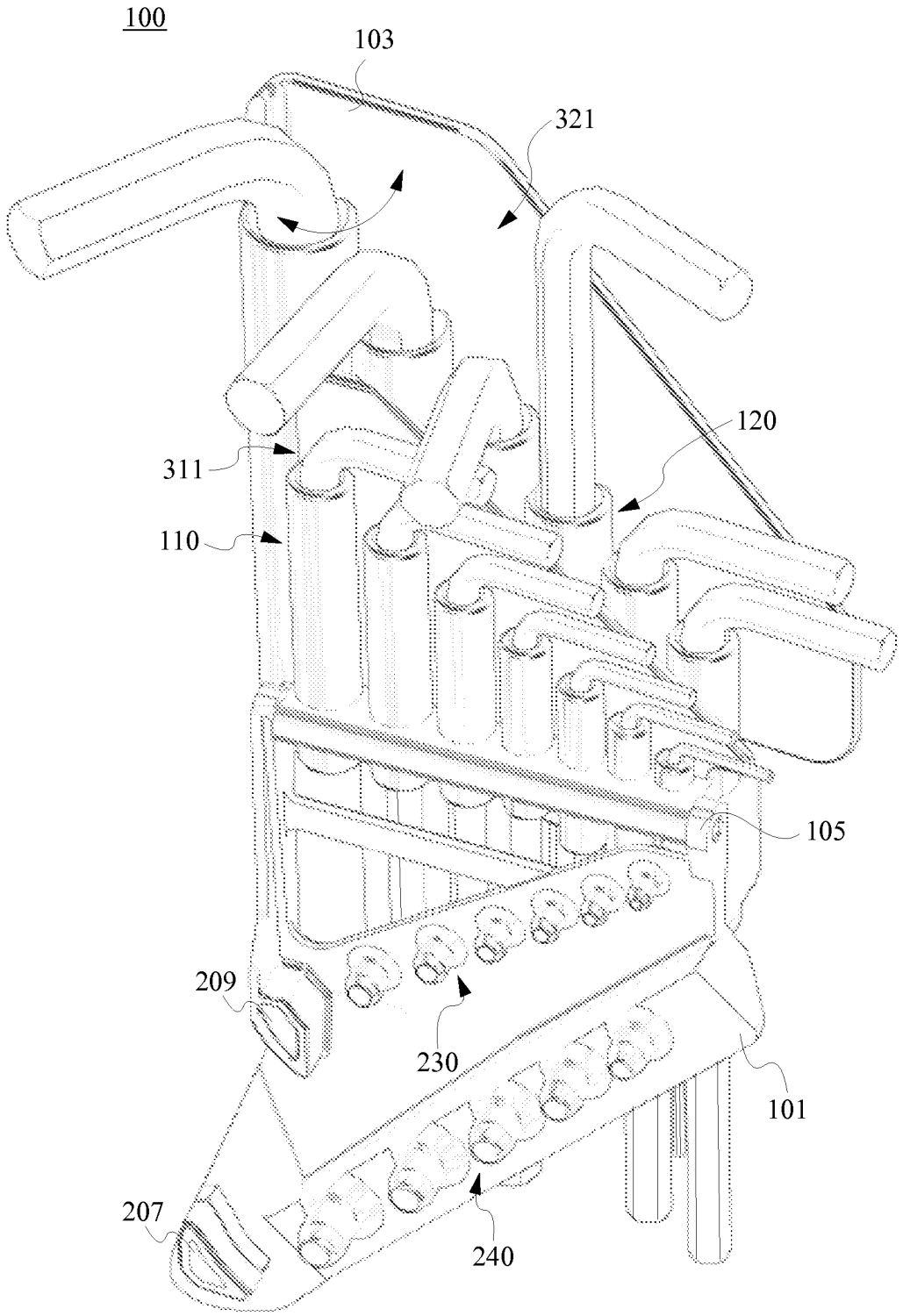
FIGS. 3A and 3B illustrate a tool holder holding a plurality of tools in accordance with some embodiments.
Figure 3B:
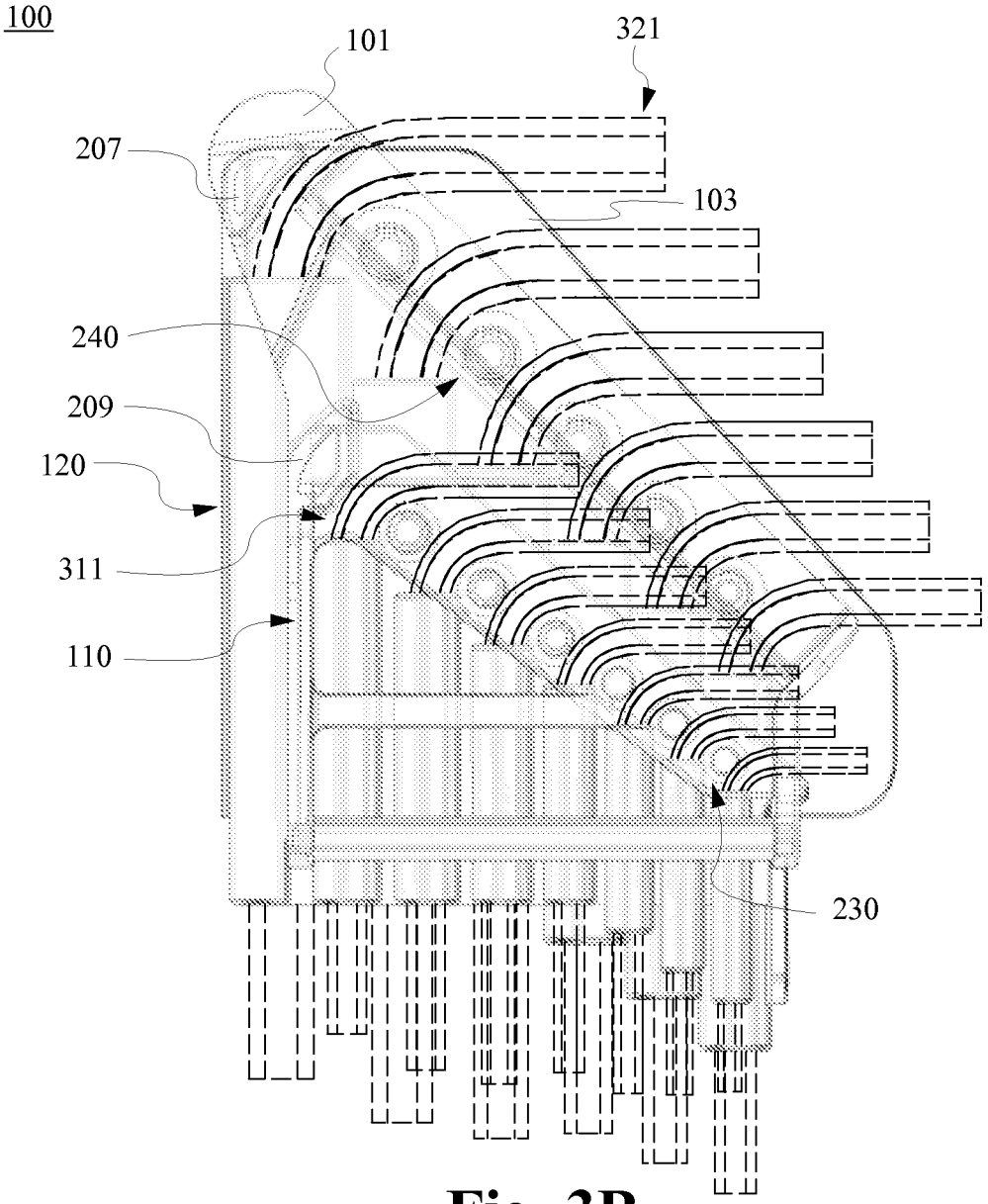

FIGS. 3A and 3B illustrate a tool holder coupled with a plurality of tools in accordance with some embodiments. The tool holder 100 shown in FIGS. 3A and 3B is similar to the tool holder 100 as described in relation to FIG. 1 and comprises a tool holder body having a lock door 101, a back panel 103, and a hinge 105. The tool holder body also comprises a first set of a first set of tool retainers 110 and a second set of tool retainers 120. In some embodiments, the tool retainers are holding tubes, pockets or slots. As shown in FIGS. 3A and 3B, a first set of tools 311 has been inserted into the first set of tool retainers 110 and a second set of tools 321 has been inserted into the second set of tool retainers 120. Although the plurality of tool retainers are all shown coupled with a tool, the tool holder is able to be used without tools in all of the tool retainers depending on the desired use of the tool holder.

In order to removably couple a L-shaped tool with the tool holder 100, a long leg of the L-shaped tool is placed within a correspondingly sized tool retainer. When the long leg of the L-shaped tool is in the tool retainer, the short leg of the tool extends at a 90° orientation with respect to the tool retainer. In some embodiments, when the tool is held within the tool holder, the short leg of the tool extends parallel to and against the back panel 103. In some embodiments, when the tool is held within the tool holder, the short leg of the tool is not parallel to the back panel 103. As seen within FIG. 3A, in some embodiments, when a plurality of tools are coupled with the tool handle 100 and the short leg of the tool extends parallel to and against the back panel 103, the plurality of short legs of each tool overlap each other. Consequently, in some embodiments, in order to insert and/or remove a tool from one of the tool retainers, one or more tools is rotated as indicated by the arrow so that the short leg of the tool is perpendicular to the back panel 103. In this configuration, the tool is able to easily be inserted and/or removed from the tool holder 100. As further shown within FIG. 3A, when a L-shaped tool is coupled with the tool handle 100, the long leg of the tool extends from a bottom of the tool retainer.

FIG. 3B shows the tool holder 100 coupled with a plurality of tools and the lock door 101 in a closed configuration in accordance with some embodiments. FIG. 3B, is drawn in order to show the interaction of the first set of posts 230 and the securing protrusion 209 with the first set of tools 311 and the interaction of the second set of posts 240 and the securing protrusion 207 with the second set of tools 321 when the tools are removably coupled with the tool holder 100 and the lock door 101 is placed in a closed position. As described above, in order to removably couple a L-shaped tool with the tool holder 100, a long leg of the L-shaped tool is placed within a correspondingly sized tool retainer.

As shown within FIG. 3B, when one or more tools is removably coupled with the tool holder and the lock door 101 is in the closed position, the one or more tools are held in place by the interaction of the tool retainers, the posts, the securing protrusions, and the lock door with the one or more tools. Particularly, when the lock door 101 is closed, the L-shaped tools are retained in a compact and orderly manner, which prevents them from sliding or escaping from their individual storage positions, regardless of any vacant neighboring tool storage retainers.

Figure 4A:
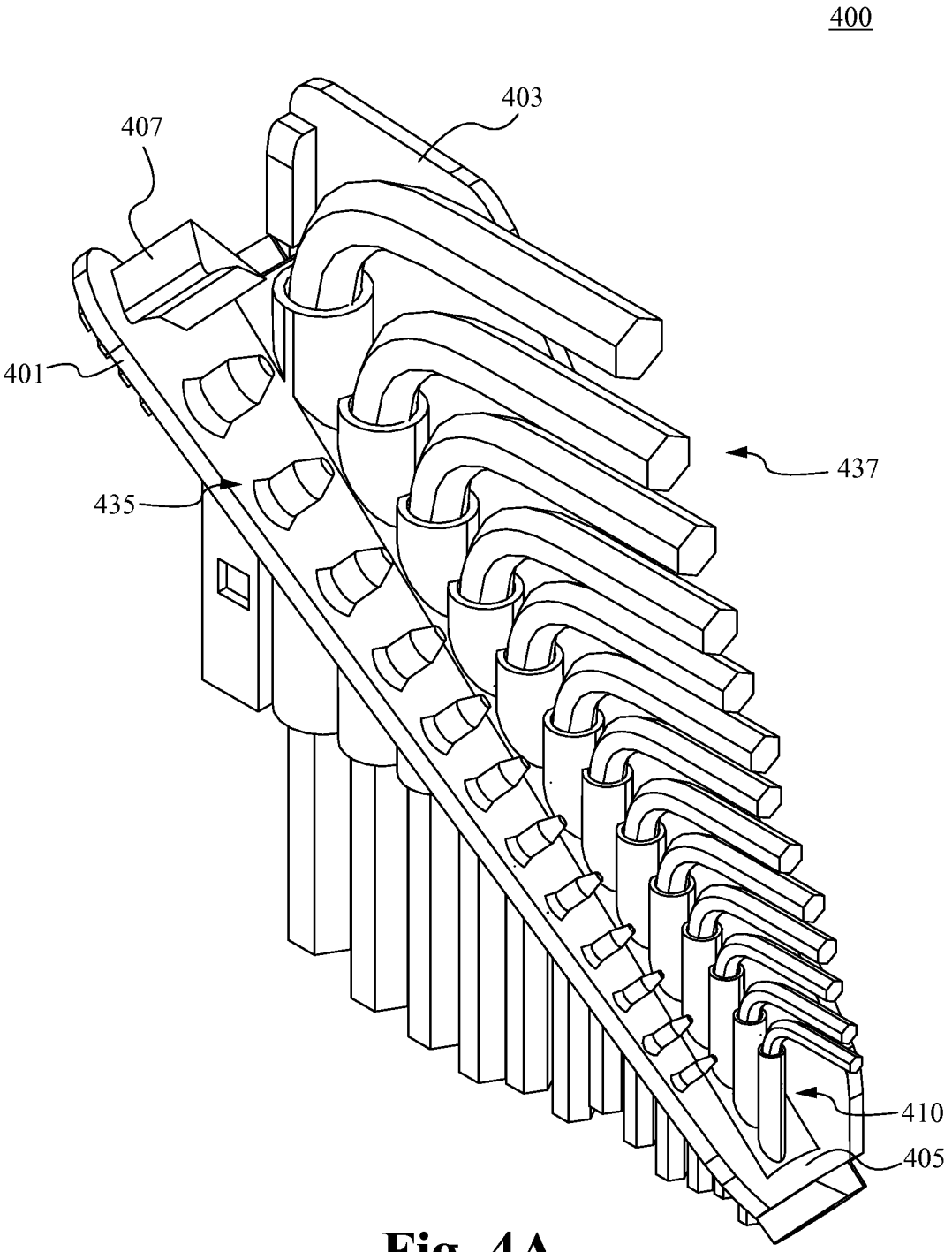
FIGS. 4A and 4B illustrate a tool holder holding a plurality of tools in accordance with some embodiments.
Figure 4B:
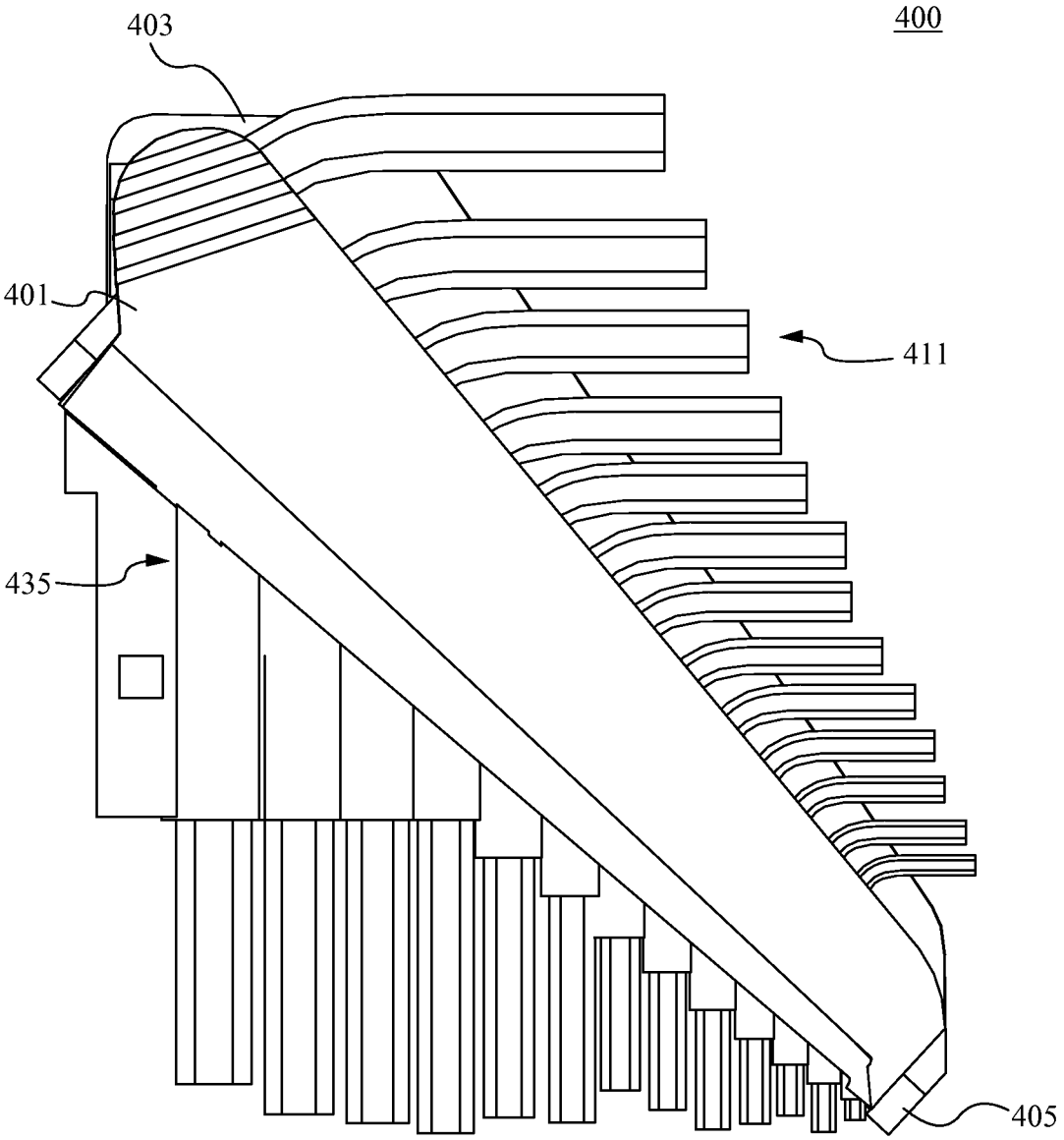

FIGS. 4A and 4B illustrate a tool holder in accordance with further embodiments. The tool holder 400 comprises a tool holder body having a lock door 401, a back panel 403, and a hinge 405. The tool holder body also comprises a plurality of tool retainers 435 for holding a plurality of tools 437. In some embodiments, the tool retainers are holding tubes, pockets or slots. The tool holder 400 shows the plurality of tool retainers 435 arranged in a single row. However, as described above, the tool retainers 435 are able to be arranged in any appropriate desired configuration.

In order to removably couple a L-shaped tool with the tool holder 400, a long leg of the L-shaped tool is placed within a correspondingly sized tool retainer. When the long leg of the L-shaped tool is in the tool retainer, the short leg of the tool extends at a 90° orientation with respect to the tool retainer. In some embodiments, when the tool is held within the tool holder, the short leg of the tool extends parallel to and against the back panel 403. In some embodiments, when the tool is held within the tool holder, the short leg of the tool is not parallel to the back panel 403. As seen within FIG. 4A, in some embodiments, when a plurality of tools are coupled with the tool holder 400 and the short leg of the tool extends parallel to and against the back panel 403, the plurality of short legs of each tool overlap each other. Consequently, in some embodiments, in order to insert and/or remove a tool from one of the tool retainers, one or more tools is rotated so that the short leg of the tool is perpendicular to its closed door or locked position and the back panel 403. In this configuration, the tool is able to be easily inserted and/or removed from the tool holder 400. As further shown within FIG. 3A, when a L-shaped tool is coupled with the tool holder 400, the long leg of the tool extends from a bottom of the tool retainer.

FIG. 4B shows the tool holder 400 coupled with a plurality of tools and the lock door 401 in a closed configuration in accordance with some embodiments. FIG. 4B, is drawn in order to show the interaction of the first set of posts 440 and the securing protrusion 409 with the first set of tools 411 and the interaction of the second set of posts 440 and the securing protrusion 407 with the second set of tools 421 when the tools are removably coupled with the tool holder 400 and the lock door 401 is placed in a closed position. As described above, in order to removably couple a L-shaped tool with the tool holder 400, a long leg of the L-shaped tool is placed within a correspondingly sized tool retainer.

As shown within FIG. 4B, when one or more tools is removably coupled with the tool holder and the lock door 401 is in the closed position, the one or more tools are held in place by the interaction of the tool retainers, the posts, the securing protrusions, and the lock door with the one or more tools. Additionally, when the lock door 401 is closed, the L-shaped tools are retained in a compact and orderly manner, which prevents them from sliding or escaping from their individual storage positions, regardless of the vacant neighboring tool storage tube slots.

Figure 5:
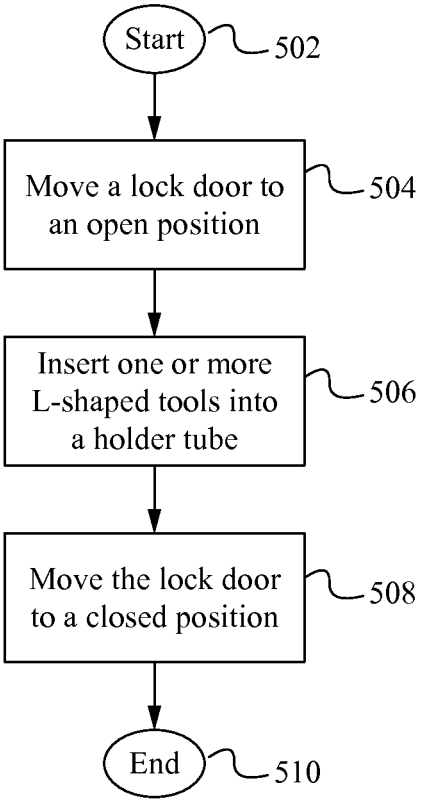
FIG. 5 illustrates a method of removably coupling a tool with a tool holder in accordance with some embodiments.

FIG. 5 illustrates a method of removably coupling a L-shaped tool with a tool holder in accordance with some embodiments. In the step 504, a lock door of the tool holder is moved to an open position. In some embodiments, the lock door is moved to the open position by rotating it about a hinge to an open position. In some embodiments, the lock door is moved to the open position by removing it from the tool holder, sliding the lock door and/or retracting it. In the step 506, one or more L-shaped tools is inserted into a tool retainer of the tool holder. In some embodiments, the tool retainers are holding tubes, pockets or slots. Then, in the step 508, the lock door is moved to a closed position. With the lock door in the closed position, the one or more tools is securely held within the tool holder and prevented from being removed.

In some embodiments, the tool holder is designed to be utilized with hexagonal wrenches of English sizes within the range of 0.050 inches to 3/8 inches, including a 0.050 inch hexagonal wrench, a 1/16 inch hexagonal wrench, a 5/64 inch hexagonal wrench, a 3/32 inch hexagonal wrench, a 7/64 inch hexagonal wrench, a 1/8 inch hexagonal wrench, a 9/64 inch hexagonal wrench, a 5/32 inch hexagonal wrench, a 3/16 inch hexagonal wrench, a 7/32 inch hexagonal wrench, a 1/4 inch hexagonal wrench, a 5/16 inch hexagonal wrench and a 3/8 inch hexagonal wrench.

In some embodiments, the tool holder is also designed to be utilized with hexagonal wrenches of metric sizes within the range of 1.7 mm to 10 mm, including a 1.7 mm hexagonal wrench, an 2 mm hexagonal wrench, a 2.5 mm hexagonal wrench, a 3 mm hexagonal wrench, a 3.5 mm hexagonal wrench, a 4 mm hexagonal wrench, a 4.5 mm hexagonal wrench, a 5 mm hexagonal wrench, a 5.5 mm hexagonal wrench, a 6 mm hexagonal wrench, a 7 mm hexagonal wrench, a 8 mm hexagonal wrench, a 9 mm hexagonal wrench and a 10 mm hexagonal wrench.

In further embodiments, the tool holder is designed to be utilized with star shaped wrenches of sizes within the range of T-6 to T-50.

Alternatively, the tool holder for multiple tools of different sizes is able to be used with tools other than hexagonal wrenches and star wrenches.

The tool holder is able to be composed of any appropriate material, which is of maximum strength and includes properties which resist materials that the holder will likely be exposed to, e.g., oil, grease, gasoline and the like. In some embodiments, the tool holder is materially composed of a variety of resin polymer and copolymer compositions including fillers and reinforcing materials such as glass in order to meet the strength and chemical resistance requirements of the tool. In some embodiments, the tool holder is materially composed of any suitable composition including, but not limited to aluminum or steel. In some embodiments, the tools are materially composed of aluminum, steel or any other appropriate material.

In some embodiments, the tool holder is constructed using an injection molded, core/cavity process as is well known in the art. Alternatively, the tool handle is able to be constructed in any known manner.

Throughout this description, the term tool retainers has been used to describe certain embodiments. The tool retainers, as herein described, in some embodiments are able to be tubes, pockets or slots for holding the tools.

To utilize the tool holder, one or more tools are inserted into one or more tool retainers of the tool holder body. In some embodiments, the tool retainers are holding tubes, pockets or slots. In some embodiments, the tool is a L-shaped hexagonal or round tool. Once the tool is positioned and held within the tool holder, a user is able to easily close the lock door in order to secure to the tool within the tool holder. One or more L-shaped tools are able to be retained in a compact and orderly manner, while being prevented from sliding or escaping from their individual storage positions, regardless of the vacancy of the neighboring tool storage tube slots. In this manner, one or more different sized tools are able to be easily coupled with and removed from the tool holder and stored together in a compact manner.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that other various modifications may be made in the embodiment chosen for illustration without departing from the spirit and scope of the invention as defined by the appended claims.

What is claimed is:

1. A tool holder comprising:

a. a tool holder body comprising;

i. one or more tool retainers each comprising a holding tube;

ii. a lock door, separable from the one or more tool retainers, the lock door comprising one or more posts movable between an open position and a closed position to secure a tool held within the holding tube in place to prevent the tool from being removed when the lock door is in the closed position, wherein the one or more posts fit between the one or more tool retainers when the lock door is in the closed position; and iii. a back panel.

2. The tool holder of claim 1, wherein the tool holder is configured for holding an L-shaped round or hexagonal tool.

3. The tool holder of claim 2, wherein in order to couple an L-shaped tool with the tool holder a long leg of the tool is inserted into one of the one or more tool retainers.

4. The tool holder of claim 3, wherein when the tool is coupled with the tool holder, a short leg of the tool extends at a 90° orientation with respect to the one of the one or more tool retainers and the long leg of the tool extends from a bottom of the one of the one or more tool retainers.

5. The tool holder of claim 3, wherein the tool is prevented from being removed from the one of the one or more tool retainers when the lock door is in the closed position independent of a vacancy of one or more neighboring tool retainers to the one of the one or more tool retainers.

6. The tool holder of claim 1, wherein the lock door moves to the open position by rotating away from the back panel and about a hinge.

7. The tool holder of claim 6, wherein the hinge comprises a pivot pin.

8. The tool holder of claim 1, wherein the one or more tool retainers are arranged in one of a single row and multiple rows.

9. The tool holder of claim 1, wherein the one or more posts secure an L-shaped tool in place in order to prevent the tool from being removed when the lock door is in the closed position.

10. The tool holder of claim 1, wherein the tool holder further comprises a lock that secures the lock door into place.

11. A tool holder comprising:

a. a tool holder body comprising:

i. one or more tool retainers each comprising a holding tube;

ii. a lock door, separable from the one or more tool retainers, the lock door comprising one or more securing protrusions movable between an open position and a closed position to secure a tool held within the holding tube in place to prevent the tool from being removed when the lock door is in the closed position, wherein the one or more securing protrusions fit between the one or more tool retainers when the lock door is in the closed position; and iii. a back panel.

12. The tool holder of claim 11, wherein the one or more securing protrusions interlock with the back panel in order to snap fit to the back panel and secure the lock door into place.

13. A tool holder for holding a plurality of tools comprising:

a. a tool holder body comprising a plurality of tool retainers, each comprising a holding tube for removably holding a tool; and b. a lock door, separable from the tool holder body, comprising one or more posts movable between an open position and a closed position to secure the tool held within the holding tubes in place to prevent the tool from being removed when the lock door is in the closed position, wherein the one or more posts fit between the tool retainers when the lock door is in the closed position;

wherein when a tool is coupled with a tool retainer, the tool is prevented from being removed from the tool retainer when the lock door is in the closed position independent of a vacancy of one or more neighboring tool retainers.

14. The tool holder of claim 13, wherein the tool holder is configured for holding an L-shaped round or hexagonal tool.

15. The tool holder of claim 14, wherein in order to couple an L-shaped tool with the tool holder a long leg of the tool is inserted into one of the plurality of tool retainers.

16. The tool holder of claim 15, wherein when the L-shaped tool is coupled with the tool holder, a short leg of the tool extends at a 90° orientation with respect to the holding tube and the long leg of the tool extends from a bottom of the one of the one or more tool retainers.

17. The tool holder of claim 13, wherein the lock door moves to the open position by rotating away from the back panel and about a hinge.

18. The tool holder of claim 17, wherein the hinge comprises a pivot pin.

19. The tool holder of claim 13, wherein the plurality of tool retainers are arranged in one of a single row and multiple rows.

20. The tool holder of claim 13, wherein the tool holder further comprises a lock that secures the lock door into place.

21. The tool holder of claim 13, wherein the tool holder comprises a first set of retainers and a second set of retainers.

22. A tool holder for holding a plurality of tools comprising:

a. a tool holder body comprising a plurality of tool retainers, each comprising a holding tube for removably holding a tool; and b. a lock door, separable from the tool holder body, comprising one or more securing protrusions movable between an open position and a closed position to secure a tool held within the holding tubes in place to prevent the tool from being removed when the lock door is in the closed position, wherein the one or more securing protrusions fit between the tool retainers when the lock door is in the closed position;

wherein when a tool is coupled with a tool retainer, the tool is prevented from being removed from the tool retainer when the lock door is in the closed position independent of a vacancy of one or more neighboring tool retainers.

23. The tool holder of claim 22, wherein the one or more securing protrusions interlock with the back panel in order to snap fit to the back panel and secure the lock door into place.

24. A tool holder for holding one or more L-shaped tools each comprising a short leg and a long leg, the tool holder comprising:

a. a tool holder body comprising:

i. a plurality of tool retainers each comprising a holding tube, wherein in order to couple one of the L-shaped tools with the tool holder, the long leg of the L-shaped tool is inserted into one of the plurality of tool retainers;

ii. a lock door, separable from the tool retainers, comprising one or more securing protrusions movable between an open position and a closed position to secure the one or more L-shaped tools in place in order to prevent the one or more L-shaped tools from being removed when the lock door is in the closed position, wherein the one or more securing protrusions fit between the tool retainers when the lock door is in the closed position; and iii. a back panel.

25. The tool holder of claim 24, wherein the one or more securing protrusions interlock with the back panel in order to snap fit to the back panel and secure the lock door into place.

* * * * *